US005777878A

United States Patent [19]

Helmrich et al.

[11] Patent Number: 5,777,878

[45] Date of Patent: Jul. 7, 1998

[54] SCREEN PRINTING PRESS HAVING LONGITUDINAL, LATERAL AND ANGULAR SCREEN FRAME REGISTRATION SYSTEM AND METHOD

[75] Inventors: Ivan B. Helmrich, Kansas City, Mo.; Charles C. Raney, Lenexa, Kans.

[73] Assignee: Preco Industries, Inc., Lenexa, Kans.

[21] Appl. No.: 658,025

[22] Filed: Jun. 4, 1996

[51] Int. Cl.[6] ..... B41F 15/00; B41F 15/14; B41F 15/24; B41F 15/34

[52] U.S. Cl. ..... 364/469.03; 250/559.01; 250/559.05; 250/559.29; 226/2; 226/3; 226/15; 226/16; 101/115; 101/116; 101/481

[58] Field of Search ..... 33/614; 250/559.01, 250/559.05, 559.06, 559.07, 559.08, 559.3, 559.37, 548, 559.44, 559.29; 226/2, 3, 15, 16, 18, 19, 20, 24, 27; 101/92, 178, 219, 225, 485, 138, 143, 228, 481, 115, 116, 118, 126, 127.1; 382/287, 289; 364/469.03

[56] References Cited

U.S. PATENT DOCUMENTS

| | | | |
|---|---|---|---|
| 3,788,215 | 1/1974 | Lambert | 101/123 |
| 4,498,386 | 2/1985 | Rouly et al. | 101/40 |
| 4,555,968 | 12/1985 | Raney et al. | 83/209 |
| 4,669,378 | 6/1987 | Lee | 101/115 |
| 4,697,485 | 10/1987 | Raney | 83/34 |
| 5,129,155 | 7/1992 | Hoffman et al. | 33/614 |
| 5,161,460 | 11/1992 | Andersen et al. | 101/116 |
| 5,212,647 | 5/1993 | Raney et al. | 364/474.34 |
| 5,245,922 | 9/1993 | Klemm | 101/115 |
| 5,493,969 | 2/1996 | Takahashi et al. | 101/126 |
| 5,503,068 | 4/1996 | Newman | 101/216 |

*Primary Examiner*—Emanuel Todd Voeltz
*Assistant Examiner*—Tony M. Cole
*Attorney, Agent, or Firm*—Hovey, Williams, Timmons & Collins

[57] ABSTRACT

A screen printing press is provided for printing on a web having defined, successive areas and indicia provided in predetermined positions relative to each of the defined areas. The press includes a base defining a work station, a screen supported on the base for movement between a printing position overlying the work station and an interrupted position, and a web handling assembly for advancing the web along a path of travel to successively feed the defined areas of the web toward the work station. A registration system successively positions the defined areas of the web in a desired predetermined relationship to the screen as successive defined areas are brought into a position to be printed. The registration system includes longitudinal, lateral and angular shifting mechanisms for adjusting the longitudinal, lateral and angular alignment between the screen and the web. Sensors are provided for sensing the correct positions and orientation of the indicia that are occupied when the defined areas of the web are in the predetermined relationship relative to the screen, and a controller is responsive to the sensors for controlling the longitudinal, lateral and angular shifting mechanisms to adjust the alignment between the screen and the web until the correct positions and orientation of the indicia are sensed.

29 Claims, 5 Drawing Sheets

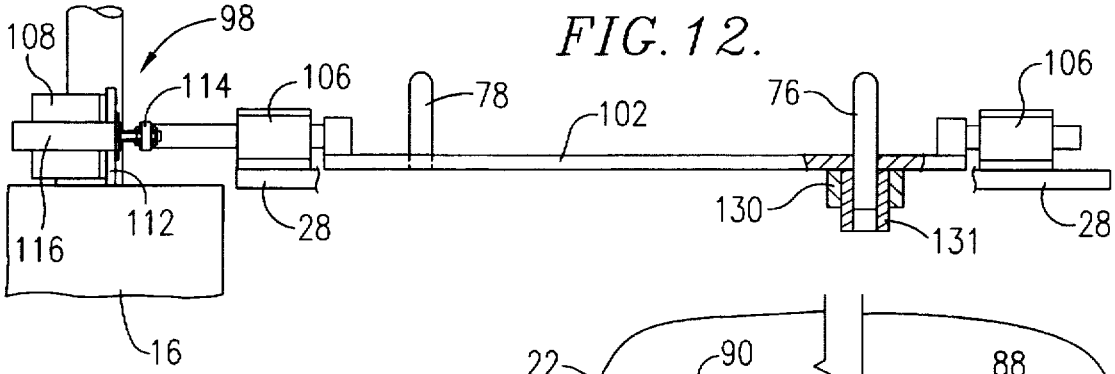
FIG. 12.
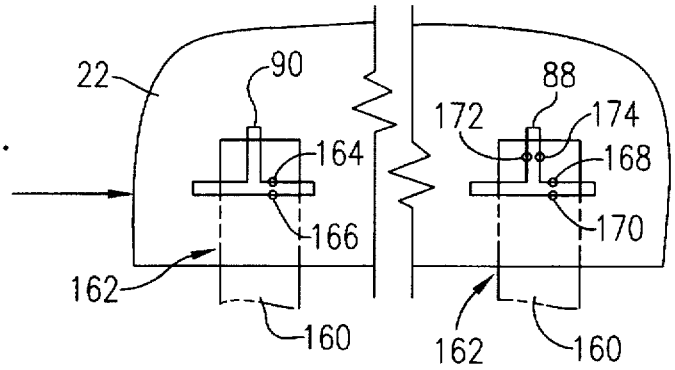
FIG. 13.
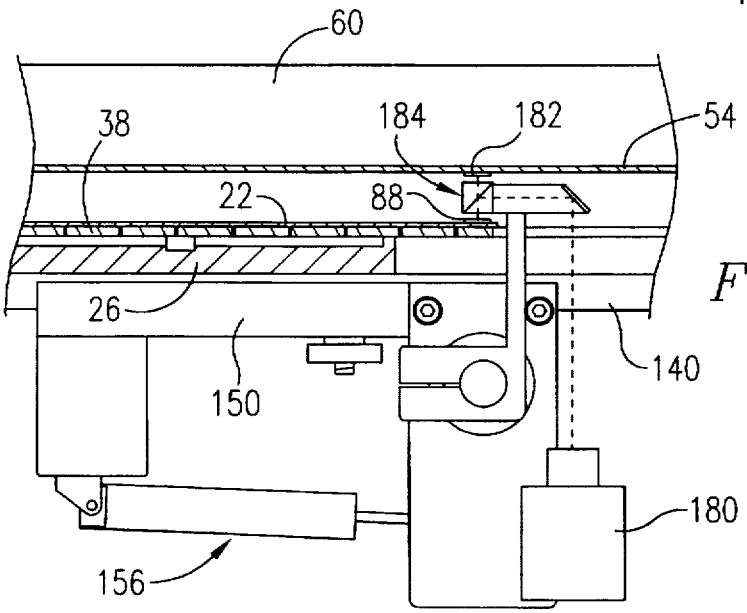
FIG. 15.
FIG. 14.
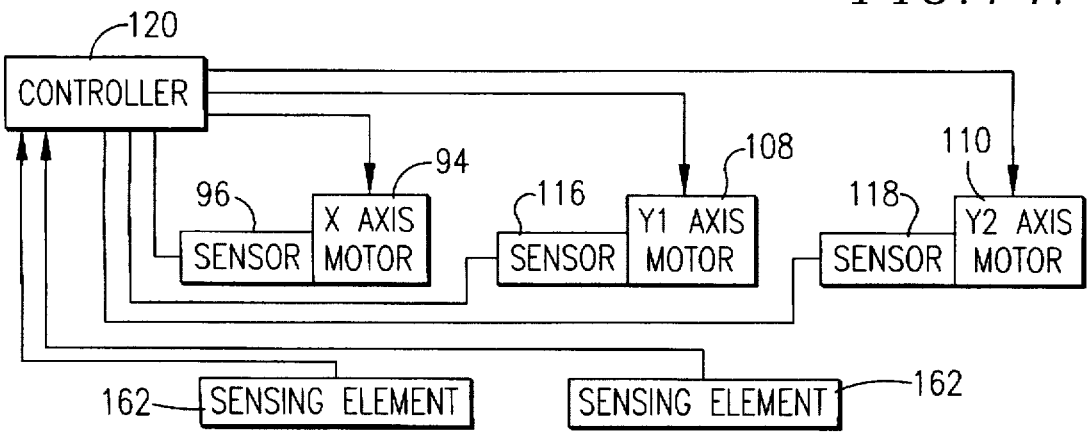

SCREEN PRINTING PRESS HAVING LONGITUDINAL, LATERAL AND ANGULAR SCREEN FRAME REGISTRATION SYSTEM AND METHOD

BACKGROUND OF THE INVENTION

1. Field of the Invention

The present invention relates generally to the art of screen printing, and more particularly to a screen printing press having a registration system for successively positioning defined areas of a web in a desired predetermined relationship to the screen as successive defined areas are brought into a position to be printed.

2. Discussion of the Prior Art

It is known to provide a screen printing press for printing on a web having defined areas that are successively brought into a position to be printed. The press includes a flat screen supported on the base of the press for movement between a printing position overlying the web and an interrupted position spaced from the web. In addition, a web handling assembly is provided for advancing the web along a path of travel to successively feed the defined areas toward a work station defined by the base.

When the web is to undergo multiple printing processes, e.g. in the production of multi-color images, it is necessary to print each individual color on the web and to dry the web prior to printing the subsequent color. Therefore, as the web is fed to the work station for the second and all subsequent printing operations, it is necessary to register each successive image, or defined area, with the screen so that all of the colors are in register with one another. Typically, such registration is achieved manually by adjusting the position of the screen on the press and printing proof images on the web until registration is obtained. Thereafter, it is assumed that the web and screen remain in register as each successive area of the web is fed a predetermined distance to the work station by the web handling system. If misregistration occurs due to stretching or contraction of the web material, the press is stopped and the screen position is re-adjusted to properly register with the web. Alternately, it is possible to manually adjust the incremental feed of the web to compensate for such misregistration.

OBJECTS AND SUMMARY OF THE INVENTION

It is an object of the present invention to provide a registration system for a screen printing press that quickly and accurately aligns defined areas of a web with a movable screen automatically as each area is moved to the work station, without requiring the constant attention of a skilled printer.

Another object of the present invention is to provide a registration system employing sensor elements that move with the screen to facilitate registration of the screen and web, wherein the sensor elements are further movable between an extended, sensing position between the web and screen, and a retracted, storage position withdrawn from between the web and screen.

Yet another object of the present invention is to provide a registration system employing a vision system including at least one camera and one or more reference indicia fixed on the screen for indicating the position at which the indicia on the web appear when defined areas of the web are in a desired predetermined relationship relative to the screen.

In accordance with these and other objects evident from the following description of a preferred embodiment of the invention, a screen printing press is provided for printing on a web having defined, successive areas and indicia provided in predetermined positions relative to each of the defined areas. The press includes a base defining a work station, a screen supported on the base for movement between a printing position overlying the work station and an interrupted position spaced from the work station, and a feeding means for advancing the web along a path of travel to successively feed the defined areas of the web toward the work station.

A registration system is provided for successively positioning the defined areas of the web in a desired predetermined relationship to the screen as successive defined areas are brought into a position to be printed. The registration system includes a longitudinal shifting means for adjusting the longitudinal alignment between the screen and the web along an X axis path of travel extending longitudinally of the web, and a lateral and angular shifting means for adjusting the lateral alignment between the screen and the web in a direction transverse to the path of travel of the web along an axis Y, and for adjusting the angular alignment between the screen and the web through an angle θ about a reference axis perpendicular to a plane containing the web. A sensing means senses the correct positions and orientation of the indicia that are occupied when the defined areas of the web are in the predetermined relationship relative to the screen, and a control means is responsive to the sensing means for controlling the longitudinal, lateral and angular shifting means to adjust the alignment between the screen and the web until the correct positions and orientation of the indicia are sensed.

By providing a registration system in accordance with the present invention, numerous advantages are realized. For example, by providing longitudinal, lateral and angular shifting means that are controlled in response to the sensed orientation of each defined area of the web to align the screen with each area, a printing press is provided which automatically registers the screen for each printing operation so that every printed image is of the same high quality.

BRIEF DESCRIPTION OF THE FIGURES

The preferred embodiment of the present invention is described in detail below with reference to the attached drawing figures, wherein:

FIG. 12 is a fragmentary end elevational view of a support bar assembly forming a part of the registration system;

FIG. 13 is a top plan view of the web, illustrating the locations sensed by the sensing elements and the position and orientation of the indicia on the web when the web is registered with the screen;

FIG. 14 is a schematic view of the registration system; and

FIG. 15 is a schematic sectional view through the base and frame unit of a screen printing press including a modified registration system constructed in accordance with the preferred embodiment.

DETAILED DESCRIPTION OF THE PREFERRED EMBODIMENT

Figure 1:
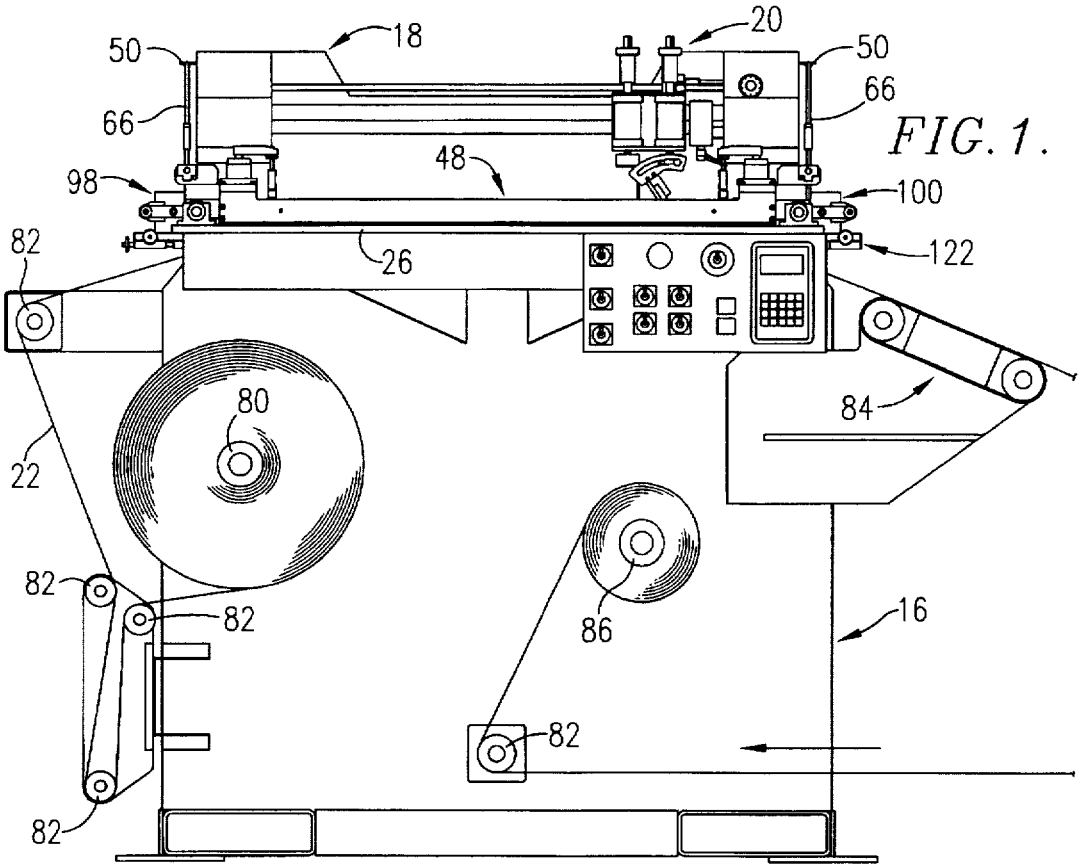
FIG. 1 is a front elevational view of a screen printing press including a registration system constructed in accordance with the preferred embodiment.

A screen printing press incorporating a registration system in accordance with the present invention is shown in FIG. 1, and broadly includes a base 16 that rests on the ground, an upper carriage 18 that is movable relative to the base and carries a screen and a squeegee assembly 20, and a web handling system supported on the base for advancing a web 22 along a path of travel to successively feed defined areas of the web toward a work station defined by the base. In addition, a registration system is provided for successively positioning the defined areas of the web in a desired predetermined relationship to the screen as successive defined areas are brought into a position to be printed.

Figure 3:
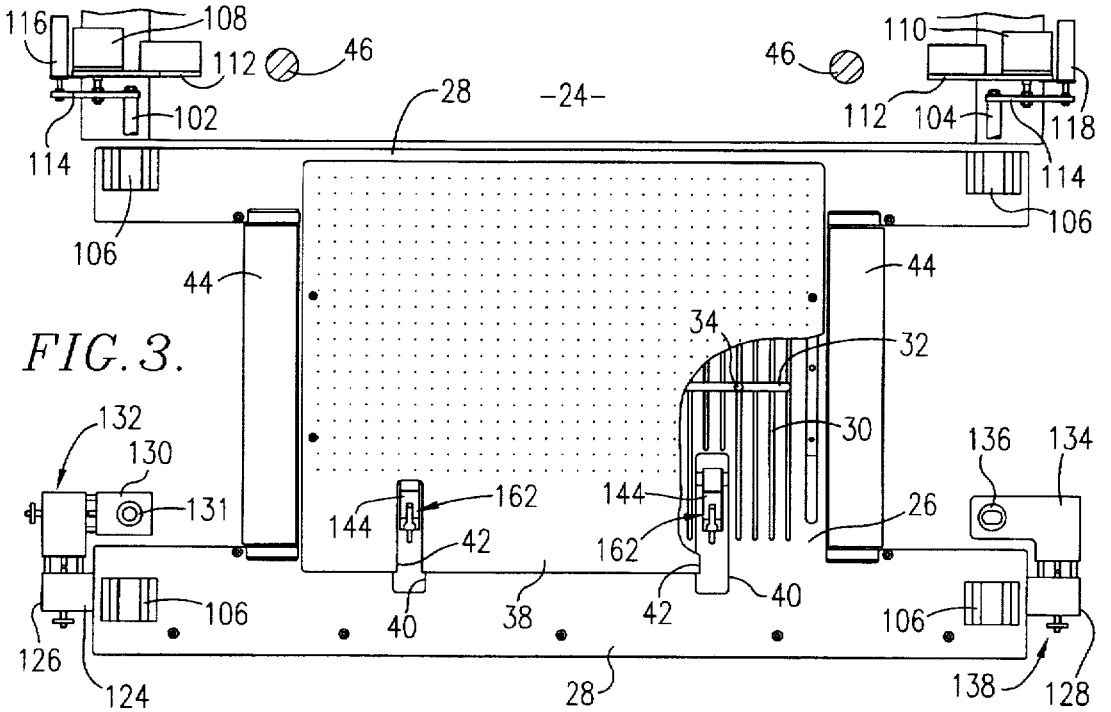
FIG. 3 is a fragmentary sectional view of the press, illustrating a base that defines a work station and forms a part of the press.

The base 16 includes front and rear walls that are spaced from one another laterally with respect to the path of travel of the web, and additional framework supports the walls and the web handling system. As shown in FIG. 3, a top wall 24 extends across the upper side of the base and defines a work station at which printing is carried out. The top wall includes a generally H-shaped base plate presenting a central platen 26 and laterally spaced, marginal strips 28. The central platen 26 includes an upper surface having laterally extending grooves 30 and a central, longitudinally extending channel 32 providing fluid communication between the grooves. The channel includes a port 34 by which it is connected to a conventional compressor so that positive or negative pressure can be supplied to the channel and the grooves to either draw a vacuum through the platen or to provide compressed air thereto.

Figure 4:
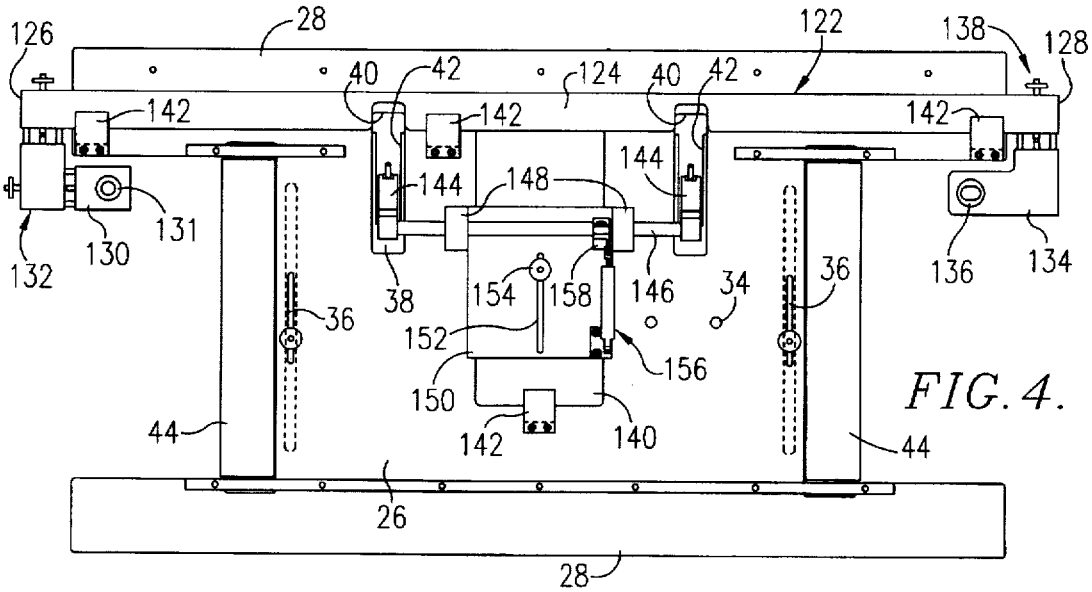
FIG. 4 is a bottom plan view of the base structure shown in FIG. 3.

As illustrated in the bottom view of FIG. 4, longitudinally spaced lateral slots 36 are formed in the platen adjacent the longitudinal ends thereof, and extend through the platen to accommodate fasteners that are used to fasten a top plate 38 to the platen 26. The fasteners permit the top plate to be shifted laterally relative to the path of travel of the web to accommodate webs of varying widths ranging between 6 and 14.5 inches in the preferred embodiment. Returning to FIG. 3, the top plate 38 is provided with a large number of small holes communicating with the grooves 30 so that a vacuum can be drawn through the holes to hold the web against the top plate during printing, and so that compressed air can be supplied through the holes to lift the web for movement across the top plate between printing operations. A pair of longitudinally spaced, laterally extending slots 40, 42 are formed in each of the platen and top plate, and the pairs of slots are in alignment with one another to present openings in the top wall of the base for receiving sensing elements forming a part of the registration system.

Figure 5:
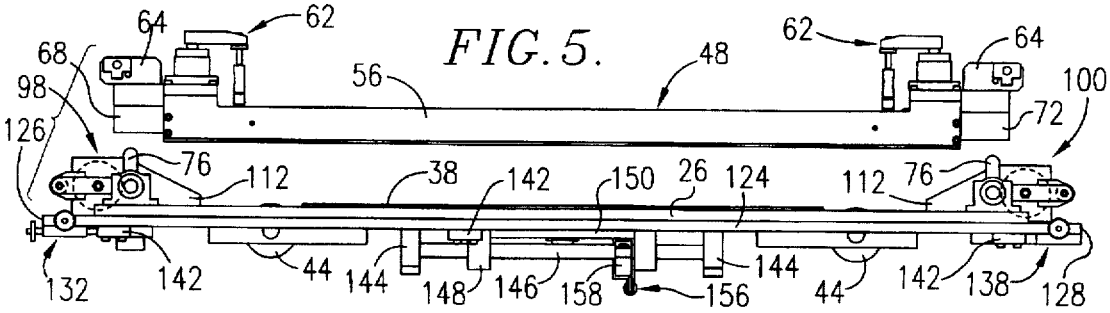
FIG. 5 is a fragmentary front elevational view of the base, illustrating a frame unit forming a part of the press.

A guide roller 44 is provided at each longitudinal end of the platen and is supported for rotation in bearings mounted on the marginal strips of the top wall. As shown in FIG. 5, the circumference of each roller 44 is preferably tangent to the upper surface of the top plate so that the web is guided across the top plate by the rollers during transport.

Figure 2:
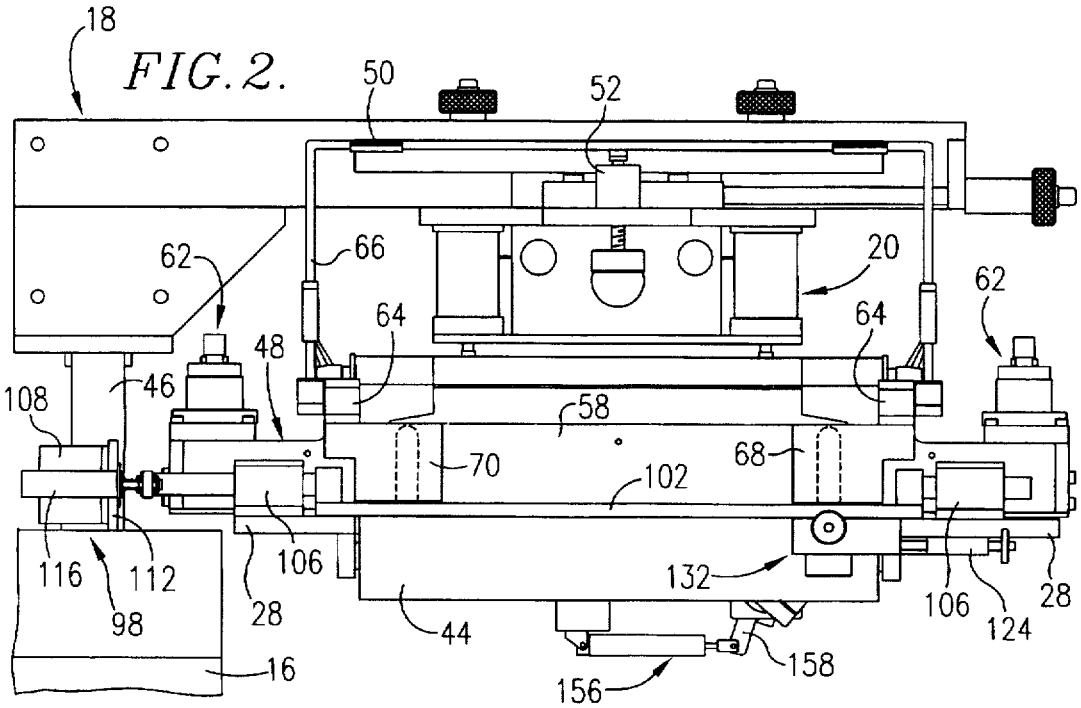
FIG. 2 is a fragmentary left end elevational view of the press.
Figure 9:
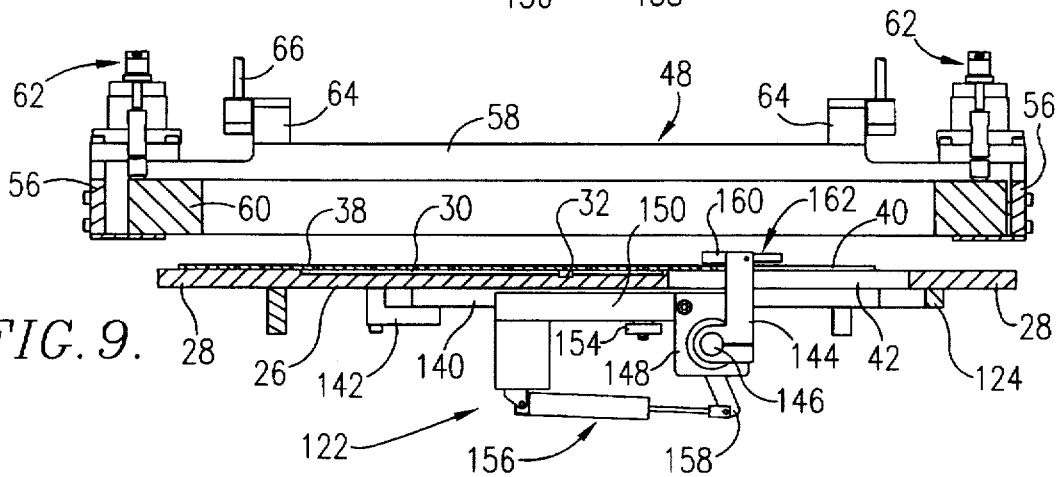
FIG. 9 is a sectional view through the base and frame unit, illustrating a sensor element forming a part of the registration system, wherein the sensor element is in an extended sensing position and the frame unit is in an interrupted position spaced from the work station.
Figure 10:
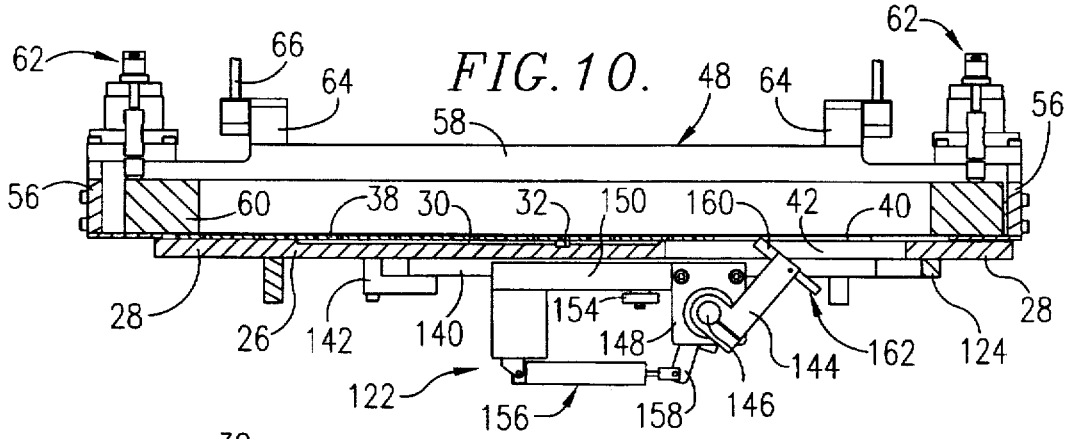
FIG. 10 is a sectional view similar to FIG. 9, illustrating the sensor element in a retracted storage position and the frame unit in a printing position overlying the work station.

Along the rear of the base, as shown in FIG. 3, a pair of longitudinally spaced upstanding rods 46 are provided. The rods support the upper carriage 18 for vertical shifting movement relative to the base between a lowered printing position in which a frame unit 48 suspended from the carriage overlies the work station as shown in FIG. 10, and a raised interrupted position in which the frame unit is spaced from the work station, as illustrated in FIG. 9. As shown in FIG. 2, the upper carriage 18 includes a pair of hinge plates 50 for supporting the frame unit, actuating cylinders 52 for pivoting the hinge plates to raise and lower the frame unit relative to the carriage, and the squeegee and flood bar assembly 20 for squeezing ink or the like through the screen onto the web during printing and for redistributing the ink across the screen subsequent to printing. An exemplary upper carriage construction is disclosed in detail in co-pending U.S. application Ser. No. 08/549,875, filed Oct. 30, 1995, by Ivan Helmrich, and entitled "Screen Angle Adjusting Alignment and Selective Screen Drive Actuating Mechanism for Screen Printing Press." A copy of the co-pending application is attached and forms a part of the present application, the substance thereof being incorporated herein.

Figure 7:
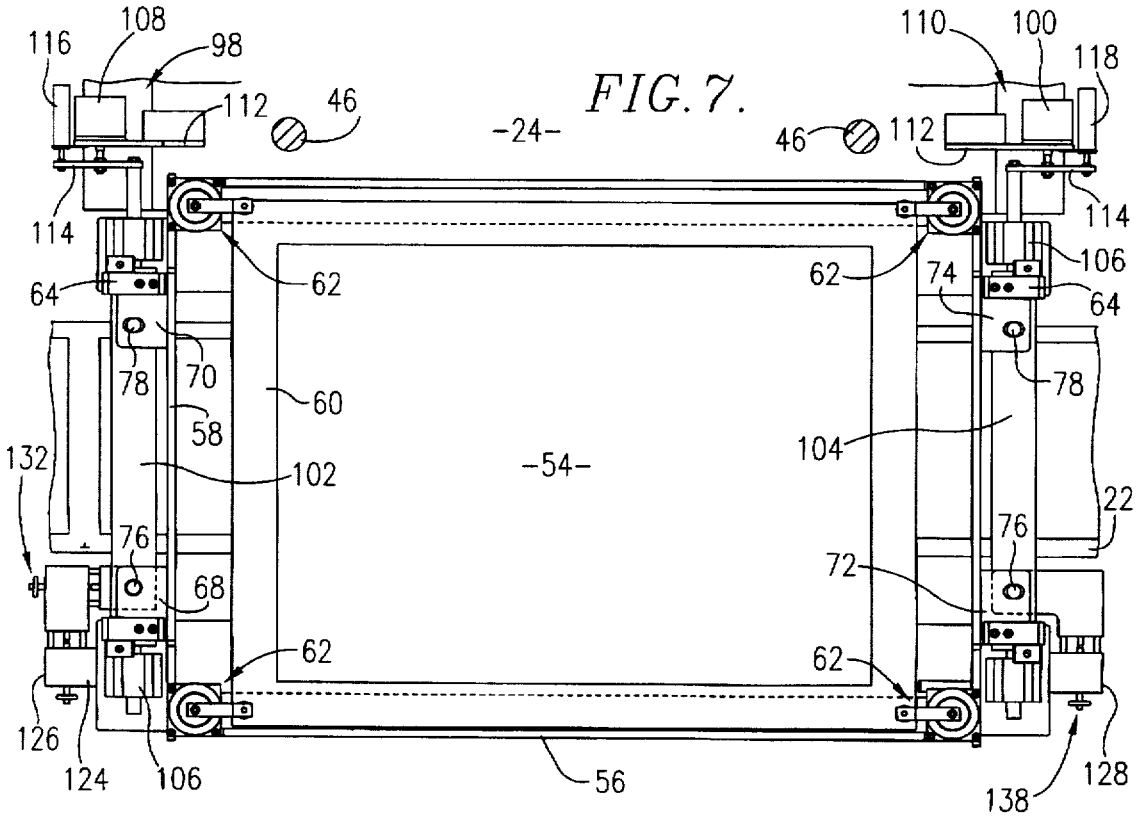
FIG. 7 is a fragmentary sectional view of the press, illustrating the base and frame unit.

Turning to FIG. 7, the frame unit 48 is adapted to receive a screen 54 to be used in any particular printing operation, and includes a main rectangular clamp frame having two laterally spaced, longitudinally extending L-shaped side frame elements 56 which are joined at the ends by cross members 58. Each screen to be mounted on the press is stretched across and secured to a simple rectangular frame 60, and the frame is positioned within the frame unit 48 and held in position against the side frame elements 56 by conventional fluid-actuated hold down assemblies 62. The screen 54 is typically formed of an ink porous material having ink blocking areas defining the area of the image to be transferred to the web during printing.

As shown in FIG. 9, a pair of laterally spaced, longitudinally extending support arms 64 extend from each cross member 58 and support a bale 66 by which the frame unit is suspended from the hinge plates of the upper carriage so that, during operation, the frame unit can be moved between the printing and interrupted positions. If desired, the bales 66 can be released from the upper carriage to free the frame unit so that the screen can be cleaned or replaced. As illustrated in FIG. 7, a pair of laterally spaced, longitudinally extending blocks 68, 70 extend from one of the cross members and blocks 72, 74 extend from the other cross member. The block 68 includes a vertically extending circular hole sized for receipt of a pin 76 forming a part of the registration system, while the remaining blocks 70, 72, 74 are provided with vertically extending holes sized for receipt of other pins 76, 78. The holes in the blocks 70, 72, 74 are shaped as elongated slots extending in a direction along the path of travel of the web and accommodate relative movement between the frame unit and the pins 76, 78 during registration, as described below.

The web handling system is shown in FIG. 1, and includes an unwind shaft 80 on which a roll of web material to be printed is supported. The web 22 is trained through a series of guide and tensioning rollers 82, across the top plate of the work station, over a conventional vacuum belt web feed mechanism 84, through a conventional dryer and onto a rewind shaft 86 supported on the base. Preferably, at least one of the rollers 82 maintains the web in tension at all times and removes slack that develops as a result of operation of the web feed mechanism 84. Thus, it is possible to drive the web feed mechanism in either direction to obtain longitudinal alignment between the web and the screen, in a manner described below, and any slack created in the web during such movement is taken up by the tension roller.

Figure 6:
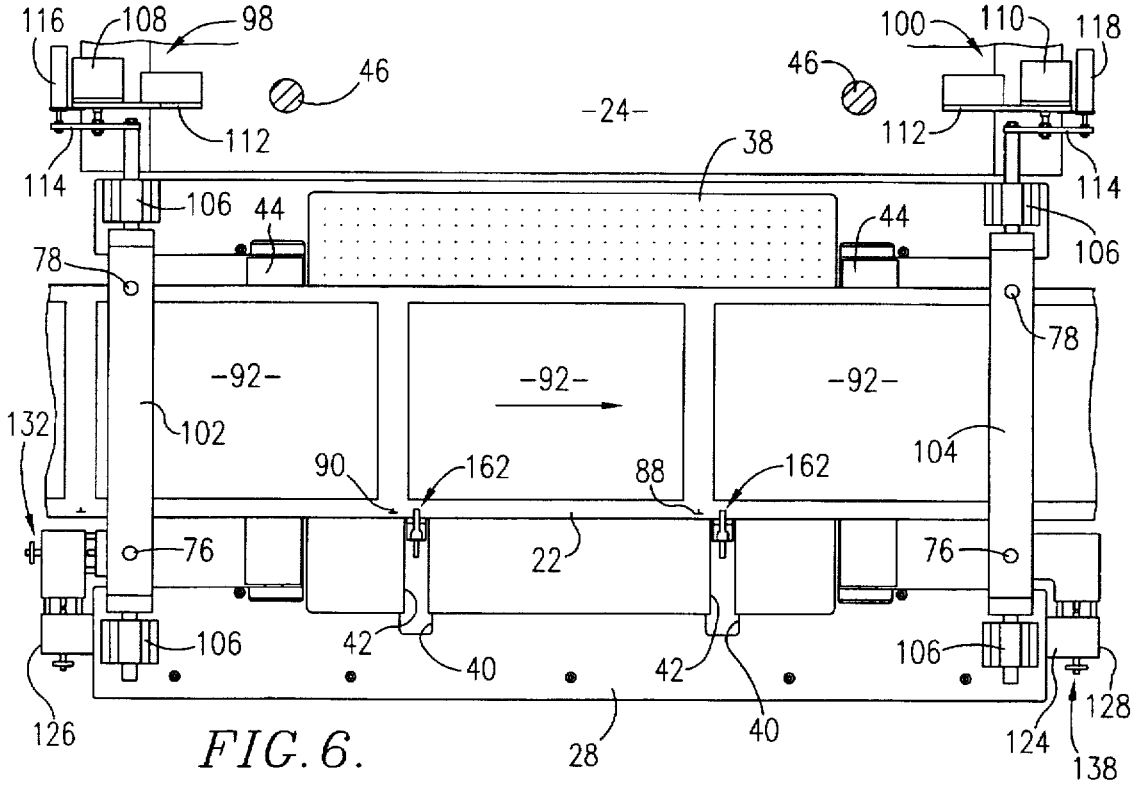
FIG. 6 is a fragmentary sectional view similar to FIG. 3, illustrating a web to be printed.

When the web is to undergo multiple printing processes, e.g. in the production of multi-color images, it is necessary to print each individual color on the web and to dry the web prior to printing the subsequent color. In order to permit proper registration between the web and each screen used for printing a color on the web, the web is provided with a pair of longitudinally spaced indicia 88, 90, as shown in FIG. 6, corresponding to each defined area 92 of the web to be printed. Preferably, each indicium is T-shaped, as illustrated in FIG. 13, presenting a laterally extending body and a pair of longitudinally extending arms. The indicia are printed along the front edge of the web on the upper surface thereof so that they face the screen to facilitate registration.

The registration system broadly includes a longitudinal shifting means for adjusting the longitudinal alignment between the screen and the web along the path of travel of the web, and a lateral and angular shifting means for adjusting the lateral alignment between the screen and the web in a direction transverse to the path of travel of the web and for adjusting the angular alignment through an angle θ between the screen and the web about a reference axis perpendicular to a plane containing the web. In addition, the registration system includes a sensing means for sensing the correct positions and orientations of the indicia that are occupied when the defined areas of the web are in the predetermined relationship relative to the screen, and a control means responsive to the sensing means for controlling the longitudinal, and lateral and angular shifting means to adjust the alignment between the screen and the web until the correct positions and orientations of the indicia are sensed.

As shown in FIG. 1, the longitudinal shifting means preferably includes the vacuum belt web feed mechanism 84 and the rollers 82 that tension the web. As mentioned, the feed mechanism can be operated in either direction to shift the web longitudinally back and forth into registration with the screen, and the tensioning rollers maintain the web in tension and takes up any slack in the web. The feed mechanism 84 preferably includes a conventional motor 94, shown schematically in FIG. 14, that can be driven at different speeds so that each successive area of the web can be fed toward the work station a predetermined distance at a relatively fast speed, and then slowed to a relative creep until longitudinal registration is sensed. Preferably, a potentiometer 96 or other detecting means is provided for detecting the angular position of an output shaft of the motor to provide feedback to the control means for permitting control of the motor so that it is possible to accurately position the web along the path of travel.

The lateral and angular shifting means are shown in FIG. 6, and together include a pair of longitudinally spaced support bar assemblies 98, 100 that engage the frame unit 48 and position the unit relative to the work station and the web. The support bar assemblies include laterally extending support bars 102, 104 that are each supported for axial shifting movement in a direction transverse to the path of travel of the web by a pair of bearings 106 secured to the top wall of the base. A pair of laterally spaced, vertically extending pins 76, 78 are secured to the support bar 102 and are received in the holes in blocks 68, 70 of the frame unit, as shown in FIG. 7, to position the frame unit on the support bar 102. Similarly, the pair of laterally spaced, vertically extending pins 76, 78 on the support bar 104 are received in the holes in blocks 72, 74 of the frame unit to position the frame unit on the support bar 104.

The support arm assemblies 98, 100 also include motors 108, 110 for shifting the support arms laterally back and forth within the bearings. Each motor is supported on the top wall of the base by a bracket 112 and includes an axially shiftable output shaft that is connected to one of the support bars 102, 104 by a rigid link 114 extending between the output shaft and the associated bar. Each link extends longitudinally beyond the respective motor 108, 110 and is connected to a linear potentiometer 116 or 118 for sensing the lateral position of the corresponding support arm. Thus, as shown in FIG. 14, the motor 108 defines a $Y_1$ axis motor and the motor 110 defines a $Y_2$ axis motor, and the potentiometers 116, 118 provide a feedback to a controller 120 forming the control means for permitting control of the motors to properly position the support bars.

Because the pins 76, 78 of the support bars are received in the blocks 68, 70, 72, 74 of the frame unit, the lateral and angular position of the frame unit relative to the web is dictated by the positions of the support bars. If both support bars are shifted laterally an equal distance to one another, the lateral position of the frame unit is changed relative to the web and the underlying work station. If one of the support bars is shifted laterally relative to the other support bar, the frame is pivoted about the pin received in the hole, and the angular position of the frame unit is adjusted. Thus, both lateral and angular alignment of the frame unit and screen with each successive defined area of the web is achieved through appropriate energization of one or both of the motors 108, 110.

Figure 8:
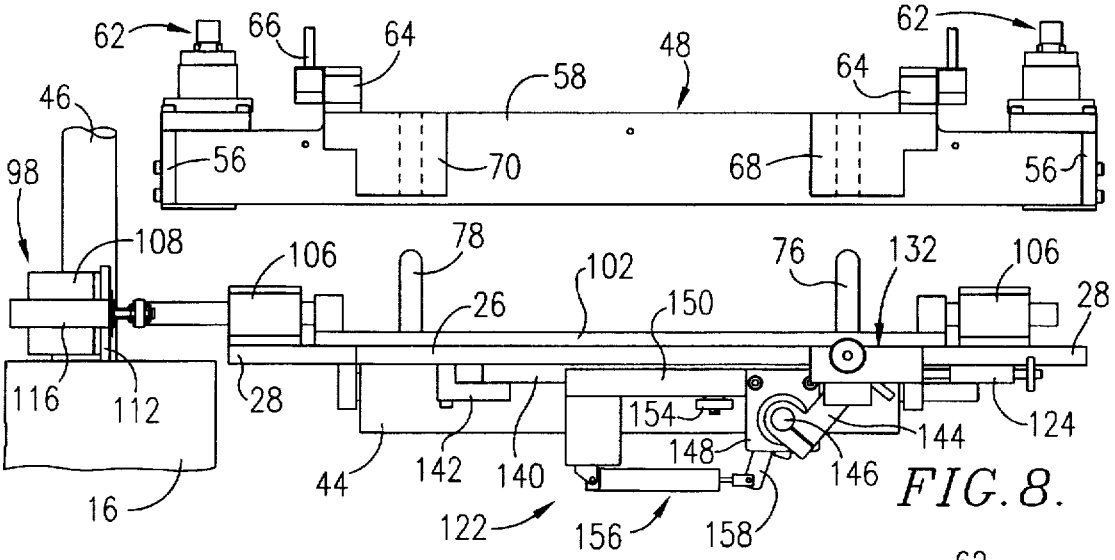
FIG. 8 is a fragmentary end elevational view of the press, illustrating the base and frame unit.

With reference to FIG. 4, the sensing means of the registration system includes a sensor assembly 122 that is supported for movement with the support bar assemblies 98, 100 and extends beneath one of the marginal strips 28 of the base plate. The sensor assembly includes a longitudinally extending undercarriage 124 having opposed axial ends that protrude beyond the marginal strips of the top wall. As shown in FIG. 6, a block 130 is positioned adjacent the bottom of the support bar 102 in alignment with the pin 76, and includes a vertically extending circular bushing 131, shown in FIG. 12, within which a lower portion of the pin 76 is received for locating the block relative to the support bar. This construction is illustrated in FIG. 8, and insures that both the frame unit and the undercarriage are moved together as a unit with the support bars.

As shown in FIG. 3, the end 126 of the undercarriage is secured to the block 130 through a conventional vernier mechanism 132 which permits fine adjustment of the longitudinal and lateral position of the undercarriage relative to the support bar 102. Similarly, a block 134 is positioned adjacent the bottom of the support bar 104 in alignment with the pin 76, and includes a vertically extending slot-shaped bushing 136 within which the pin is received for locating the block relative to the support bar. The end 128 of the undercarriage is secured to the block 134 through a vernier mechanism 138 which permits the lateral position of the undercarriage to be adjusted relative to the support bar 104 and accommodates relative longitudinal and angular adjustments that are made at the opposite end 126 of the undercarriage.

Returning to FIG. 4, the undercarriage includes a laterally extending tongue 140 that protrudes inward beneath the platen 26. The undercarriage and tongue are suspended beneath the base by a plurality of tabs 142 secured to the base at spaced locations along the undercarriage. The tabs support the weight of the undercarriage while permitting the undercarriage to be shifted relative to the top wall. A pair of notches are formed in the undercarriage in longitudinal alignment with the slots 40, 42 of the top wall and top plate. The slots are sized to accommodate a pair of arms 144 that are carried by the undercarriage. The arms are mounted on a common shaft 146 that is supported for rotation in a pair of bearings 148, and the bearings are secured to a collar 150 that, in turn, is supported on the tongue of the undercarriage for relative lateral shifting movement.

Figure 11:
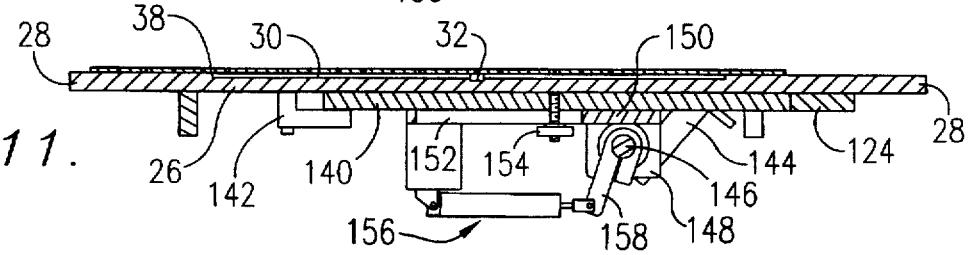
FIG. 11 is a sectional view through the base and frame unit, illustrating an actuating mechanism of the sensor element.

A laterally extending slot 152 is formed in the collar for receiving a threaded fastener that is secured to the tongue, and a knurled nut 154 is received on the fastener for securing the collar in place on the tongue. Thus, it is possible to adjust the lateral position of the collar and the arms relative to the tongue to accommodate webs of various widths, as described below. As shown in FIG. 11, a pneumatic piston and cylinder assembly 156 is supported on the collar 150 and includes a piston connected to the shaft through a lever arm 158 so that the shaft is rotated when the piston and cylinder assembly is actuated. Thus, the arms 144 are pivoted between an extended sensing position, as shown in FIG. 9, and a retracted storage position, as shown in FIG. 10.

Each arm 144 includes an upper, laterally extending finger 160 that protrudes inward over the web in the sensing position of the arm. Sensing elements 162 are carried by each arm and each element includes a bundle of optical fibers, wherein each bundle presents a distal end extending through the finger and directed vertically downward toward the web in the sensing position of the arm, and a proximal end that is accessible for connection to an optical coupler so that light can be transmitted between the fibers of the bundle and the control means. Preferably, one of the arms 144 includes two bundles of optical fibers directed toward locations 164, 166 that are spaced laterally from one another, as shown in FIG. 13. In the preferred embodiment, the lateral spacing between the locations 164, 166 is about 0.040 inches, center to center. The other arm 144 preferably includes four bundles of optical fibers, two of which are directed toward locations 168, 170 that are spaced laterally from one another similar to the locations 164, 166, and two 172, 174 of which are directed toward locations that are spaced longitudinally from one another.

A series of flexible light transmitting glass fibers make up each of the bundles. Certain of the fibers act as light transmitters leading from a light source located remotely of the arms to each of the exposed distal ends of the bundles. Certain other fibers of each bundle function as light receptors leading from the exposed ends thereof to light responsive means in the nature of conventional phototransistors operably associated with respective bundles.

With reference to FIG. 14, the controller 120 forming the control means is conventional, and includes an input keypad, shown in FIG. 1, and a central processing unit responsive to the signals generated by the phototransistors of the sensing elements 162 for controlling the motors 94, 108, 110 to adjust the alignment of each successive defined area of the web relative to the screen to obtain registration prior to printing. Returning to FIG. 14, the potentiometers 96, 116, 118 provide feedback to the controller for controlling operation of the motors to carry out the desired movement of the shifting means in each direction desired to obtain registration. In addition, the controller continuously monitors the signals received from the phototransistors of the sensing elements to obtain and confirm proper registration.

With reference to FIG. 6, prior to operation of the press, the top plate 38 is adjusted laterally on the base plate so that the inner edges of the slots 42 are aligned with the front edge of the web 22. For example, if a relatively narrow web is to be printed, the top plate is shifted laterally inward, and for wider webs it is shifted outward. Thereafter, referring to FIG. 4, the collar 150 is adjusted on the tongue 140 of the undercarriage to position the arms 144 within the slots 40, 42 so that the fingers of the arms protrude inward beyond the inner edges of the slots and over the web when the arms are pivoted to the sensing position, as shown in FIG. 6.

Once the top plate and collar are properly positioned and secured in place, the web is mounted on the unwind shaft and trained through the press in a manner as described above. One of the successive defined areas 92 on the web, for example an area previously printed on the web in a different color, is manually brought into general longitudinal alignment with the work station by manipulating the feed mechanism to advance the web a desired distance. Preferably, light can be provided through the sensing elements 162 to illuminate the locations toward which the bundles are directed in the sensing position of the arms, as shown in FIG. 13, and this visual image is used to manually register the defined area with the screen in the longitudinal, lateral and angular directions.

Once registration of the first defined area is obtained, the press is activated to print an image on the defined area and successive areas are automatically brought into registration with the screen and printed. As each successive area 92 is fed toward the work station, the speed of the feed mechanism 84 slows to a creep until the presence of the indicium 88 is sensed between the locations 172, 174. This signals longitudinal registration and triggers operation of the motors 108, 110 to shift the frame unit laterally until the presence of at least one of the indicia is sensed between the locations 168, 170 or between the locations 164, 166. At the same time, or sequentially, one or both of the motors 108, 110 are energized to adjust the angular orientation of the frame unit until the presence of both indicia 88, 90 are sensed between the locations 164, 166 and 168, 170.

During lateral and angular shifting of the frame unit, the presence of the indicium 88 between the locations 172, 174 is maintained as necessary in response to the signals received from the corresponding sensing elements by controlling operation of the feed mechanism 84 to shift the web longitudinally. Thus, longitudinal, lateral and angular alignment between the screen and the web is automatically achieved in response to the sensing means.

Once registration is confirmed, the piston and cylinder assembly 156 is actuated to pivot the arms to the retracted storage position shown in FIG. 10, beneath the top plate and out of the space between the web and the screen. Thereafter, the upper carriage lowers the frame unit 48 to the printing position and the squeegee assembly is activated to carry out printing of an image through the screen onto the defined area. Subsequent to the printing step, the upper carriage lifts the frame unit to the interrupted position shown in FIG. 9, preferably peeling the screen from the web at an angle so that the next successive area can be fed to the work station.

With reference to FIG. 3, during feeding of the web, compressed air is provided to the platen 26 and is delivered through the holes in the top plate 38 to provide a cushion of air on which the web is supported as it is fed through the work station. The flow of compressed air is preferably cut off during registration, and a vacuum is drawn through the top plate once registration is obtained, holding the web against the top plate during printing.

Although the present invention has been described with reference to the preferred embodiment, it is noted that equivalents may be employed and substitution made herein without departing from the scope of the invention as recited in the claims. For example, it is possible to employ a vision system for further improving the accuracy of the registration system. As shown in FIG. 15, the vision system includes at least one camera 180 for receiving images from the desired locations that are occupied by the indicia 88, 90 when the defined areas 92 of the web are in the predetermined relationship relative to the screen. Preferably, two cameras are employed, each spaced longitudinally from the other along the path of travel of the web, and both cameras are supported on an undercarriage similar to the undercarriage 124, and are movable with the frame unit through the action of the support bar assemblies 98, 100.

A reference means is provided in association with the vision system for providing reference image data representative of the desired locations of the indicia relative to the screen. Preferably, the reference means includes a pair of reference indicia 182 that are fixed on the underside of the screen and immediately overlying the positions at which the indicia on the web appear when each successive defined area of the web is in the desired predetermined relationship relative to the screen.

Arms similar to the arms 144 are supported on the undercarriage and are movable between an extended sensing position in which the upper ends of the arms are disposed directly beneath the reference indicia and overlie the web, and a retracted storage position beneath the top plate. The upper end of each arm supports a dual prism 184 which receives light from immediately above and beneath the prism and directs the light laterally toward a mirror that reflects the light downward toward one of the cameras 180. By providing this construction, the reference indicia and the actual indicia on the web are visible within the images received by the cameras 180, and these images are used by a controller to generate longitudinal, lateral and angular difference data representative of the difference in position between the indicia within the image and the desired locations of the indicia.

The controller that is used with the vision system includes a comparison means for making this comparison of the relative locations of the indicia within the images received by the cameras after the web has been advanced by the feeding means, and generating the difference data, and the controller uses the longitudinal, lateral and angular difference data to operate the longitudinal, lateral and angular shifting means to change the alignment between the screen and the web to compensate for the difference in position between the indicia within the image and the desired locations of the indicia so that one of the defined areas of the web is positioned in the desired predetermined relationship with the screen. Thus, a registration system employing the vision system is configured in a manner as shown in FIG. 14, wherein the target sensors are cameras rather than the sensing elements employed in the embodiment of FIGS. 1–14.

What is claimed is:

1. In a screen printing press for a web having defined, successive areas and indicia provided in predetermined positions relative to each of the defined areas, the press including a base defining a work station, a screen supported on the base for movement between a printing position overlying the work station and an interrupted position spaced from the work station, and a feeding means for intermittently advancing the web along a path of travel to successively feed the defined areas of the web toward the work station, a registration system for successively positioning the defined areas of the web in a desired predetermined relationship to the screen as successive defined areas are brought into a position to be printed, the registration system comprising:

a longitudinal shifting means for adjusting the longitudinal alignment between the screen and the web along an X axis coincident with the path of travel of the web;

a lateral and angular shifting means for adjusting the lateral alignment between the screen and the web along a Y axis in a direction transverse to the path of travel of the web and for adjusting the angular alignment between the screen and the web through an angle θ about a reference axis perpendicular to a plane containing the web;

a first X axis sensing means for sensing the correct X axis position of indicia associated with a defined area as each defined area is moved toward the work station;

a second Y axis and θ angle sensing means movable with the screen at said printing station for sensing the correct Y axis and θ angle positions and orientation of the indicia that are occupied when the defined areas of the web are in the predetermined relationship relative to the screen; and a control means responsive to the first and second sensing means for selectively controlling the longitudinal and the lateral and angular shifting means to adjust the alignment between the screen and the web until correct positions and orientation of the indicia are sensed.

2. A registration system as recited in claim 1, wherein the feeding means is the longitudinal shifting means.

3. A registration system as recited in claim 1, further comprising a pair of longitudinally spaced, laterally extending support bars on which the screen is supported for movement, each support bar being supported on the base for axial shifting movement in a direction transverse to the path of travel of the web, the lateral and angular shifting means including a pair of motors supported on the base, each motor having an axially shiftable output shaft connected to one of the support bars for shifting the support bar when the motor is energized such that lateral alignment between the screen and web is achieved by energization of both motors to shift the support bars relative to the base without shifting the bars relative to one another, and angular alignment is achieved by energization of the motors to shift the support bars relative to one another.

4. A registration system as recited in claim 3, wherein the second sensing means includes a pair of sensing elements suspended from the support bars so that the sensing elements are moved with the support bars upon actuation of the lateral and angular shifting means.

5. A registration system as recited in claim 3, further comprising a frame unit on which the screen is supported, wherein the support bars each include a pair of spaced vertical pins, and the frame unit includes structure defining a circular hole and three slots, each aligned with one of the pins of the support bars so that the frame is supported for movement with the support bars, the circular hole defining a vertical axis about which the frame unit is pivoted upon actuation of the angular shifting means to adjust the angular alignment between the screen and the web.

6. A registration system as recited in claim 4, wherein the sensing elements are supported for movement between an extended sensing position and a retracted storage position, the registration system further including an actuator for moving the sensing elements between the sensing and storage positions.

7. A registration system as recited in claim 6, wherein the sensing elements, in the sensing position, extend over the work station between the web and the screen.

8. A registration system as recited in claim 7, wherein each sensing element includes at least one fiber optic bundle directed toward the web when the sensing element is in the sensing position.

9. A registration system as recited in claim 1, wherein the second sensing means includes a pair of sensing elements movable with the screen.

10. In a screen printing press for a web having defined, successive areas and indicia provided in predetermined positions relative to each of the defined areas, the press including a base defining a work station, a screen supported on the base for movement between a printing position overlying the work station and an interrupted position spaced from the work station, and a feeding means for intermittently advancing the web along a path of travel to successively feed the defined areas of the web a predetermined distance toward the work station, a registration system for successively positioning the defined areas of the web in a desired predetermined relationship to the screen as successive defined areas are brought into a position to be printed, the registration system comprising:

a longitudinal shifting means for adjusting the longitudinal alignment between the screen and the web along an X axis coincident with the path of travel of the web;

a lateral and angular shifting means for adjusting the lateral alignment between the screen and the web along a Y axis in a direction transverse to the path of travel of the web for adjusting the angular alignment between the screen and the web through an angle θ about a reference axis perpendicular to a plane containing the web;

at least one camera movable with the screen at said printing station for receiving images from the desired locations that are occupied by the indicia when the defined areas of the web are in the predetermined relationship relative to the screen;

a reference means for providing reference image data representative of the desired locations of the indicia relative to the screen;

a comparison means for comparing the reference image data with the actual positions of the indicia within the images received by the at least one camera after the web has been advanced by the feeding means, and for generating X axis longitudinal, Y axis lateral and θ angle angular difference data representative of the difference in position between the indicia within the image and the desired locations of the indicia;

a control means for receiving the longitudinal, lateral and angular difference data and operating the X axis longitudinal, and the Y axis lateral and θ angle angular shifting means to change the alignment between the screen and the web to compensate for the difference in position between the indicia within the image and the desired locations of the indicia so that one of the defined areas of the web is positioned in the desired predetermined relationship with the screen.

11. A registration system as recited in claim 10, wherein the feeding means is the longitudinal shifting means.

12. A registration system as recited in claim 10, further comprising a pair of longitudinally spaced, laterally extending support bars on which the screen is supported for movement, each support bar being supported on the base for axial shifting movement in a direction transverse to the path of travel of the web, the lateral and angular shifting means including a pair of motors supported on the base, each motor having an axially shiftable output shaft connected to one of the support bars for shifting the support bar when the motor is energized such that lateral alignment between the screen and web is achieved by energization of both motors to shift the support bars relative to the base without shifting the bars relative to one another, and angular alignment is achieved by energization of the motors to shift the support bars relative to one another.

13. A registration system as recited in claim 12, wherein the at least one camera moves with the support bars.

14. A registration system as recited in claim 12, further comprising a frame unit on which the screen is supported, wherein the support bars each include a pair of spaced vertical pins, and the frame unit includes structure defining a circular hole and three slots, each aligned with one of the pins of the support bars so that the frame is supported for movement with the support bars, the circular hole defining a vertical axis about which the frame unit is pivoted upon actuation of the angular shifting means to adjust the angular alignment between the screen and the web.

15. A registration system as recited in claim 10, wherein the at least one camera includes a charge coupled device (CCD).

16. A registration system as recited in claim 10, wherein the reference means includes indicia affixed to the screen at positions which appear within the images received by the at least one camera.

17. A screen printing press for printing successive images on an elongated web in registration with indicia in predetermined locations on the web comprising:

a base defining a printing station;

a screen defining an image to be applied to the web and supported on the base for movement between a printing position overlying a portion of the web at said printing station and an interrupted position spaced from the printing station, said screen being adjustable laterally and angularly with respect to the printing station;

web feed mechanism engageable with the web and operable to successively advance portions of the web to the printing station;

first indicia sensor structure located to sense the presence or absence of indicia on the web;

second sensor structure movable with the screen and located to sense the orientation of the indicia on the web when the defined areas of the web are at said printing station;

mechanism connected to the screen for adjusting the screen laterally and angularly of the printing station; and a controller connected to the web feed mechanism and the first indicia sensor structure for controlling alignment of the screen with respect to the a sensed indicia longitudinally of the web, and to said mechanism for adjusting the screen laterally and angularly of the printing station to provide registration of the screen with indicia that is associated with a respective image.

18. A screen printing press as set forth in claim 17 wherein said second sensor structure includes a camera movable with the screen at said printing station.

19. A screen printing press as set forth in claim 17 wherein said first and second sensor structure comprises a camera movable with the screen at said printing station.

20. A screen printing press as set forth in claim 17 wherein said base includes a web supporting platen at said printing station, and means mounting the platen for selective shifting movement transversely of the longitudinal path of travel of the web to accommodate webs of varying widths.

21. A screen printing press for printing successive images on an elongated web in registration with indicia in predetermined locations on the web comprising:

a base defining a printing station;

a screen defining an image to be applied to the web and supported on the base for movement between a printing position overlying a portion of the web at said printing station and an interrupted position spaced from the printing station, said screen being adjustable laterally and angularly with respect to the printing station;

web feed mechanism engageable with the web and operable to successively advance portions of the web to the printing station;

first indicia sensor structure located to sense the presence or absence of indicia on the web;

second sensor structure moveable with the screen and located to sense the orientation of the indicia on the web when the defined areas of the web are at said printing station;

power mechanism connected to the screen and operable to adjust the position of the screen laterally and angularly with respect to the printing station; and a controller connected to the web feed mechanism and to the first sensor structure for interrupting advancement of the web toward the printing station when the indicia next approaching the first sensor structure during advancement of the web is in predetermined relationship with respect to the screen, and for laterally and angularly adjusting the screen with respect to the printing station until the screen is in predetermined relationship to the sensed indicia.

22. A screen printing press for printing successive images on an elongated web in registration with indicia in predetermined locations on the web comprising:

a base having a platen defining a printing station;

a screen defining an image to be applied to the web in alignment with a respective indicia on the web, said screen being supported on the base for movement between a printing position overlying a portion of the web at said printing station and an interrupted position spaced from the printing station, said screen being adjustable laterally and angularly with respect to the printing station;

web feed mechanism engageable with the web and operable to successively advance portions of the web to the indicia sensor structure having an element which is operable to sense the presence or absence of indicia on the web;

and indicia sensing element shiftably supported on said base in disposition adjacent one edge of the platen and movable between an extended indicia sensing position overlying a marginal portion of the web at said printing station in direct viewing relationship to an indicia on said marginal portion, and a retracted storage position immediately below said edge of the platen out of the path of movement of the screen toward and away from the platen; and means operably connected to the screen and to said sensor structure for adjusting the screen laterally and angularly of the printing station as required to align the screen image with a respective indicia on the web in response to sensing of the indicia on said portion of the web at said printing station by said sensing structure.

23. A screen printing press as set forth in claim 22, wherein the sensing element is mounted for swinging movement from said retracted storage position below the edge of the platen to an extended position above and overlying said marginal portion of the web at said printing station.

24. In a screen printing press for a web having defined, successive areas and indicia provided in predetermined positions relative to each of the defined areas, the press including a base defining a work station, a screen supported on the base for movement between a printing position overlying the work station and an interrupted position spaced from the work station, and a feeding means for advancing the web along a path of travel to successively feed the defined areas of the web toward the work station, a registration system for successively positioning the defined areas of the web in a desired predetermined relationship to the screen as successive defined areas are brought into a position to be printed, the registration system comprising:

a longitudinal shifting means for adjusting the longitudinal alignment between the screen and the web along the path of travel of the web;

a lateral and angular shifting means for adjusting the lateral alignment between the screen and the web in a direction transverse to the path of travel of the web and for adjusting the angular alignment between the screen and the web about a reference axis perpendicular to a plane containing the web, there being a pair of longitudinally spaced, laterally extending support bars on which the screen is supported for movement, each support bar being supported on the base for axial shifting movement in a direction transverse to the path of travel of the web, the lateral and angular shifting means including a pair of motors supported on the base, each motor having an axially shiftable output shaft connected to one of the support bars for shifting the support bar when the motor is energized such that lateral alignment between the screen and web is achieved by energization of both motors to shift the support bars relative to the base without shifting the bars relative to one another, and angular alignment is achieved by energization of the motors to shift the support bars relative to one another;

a frame unit on which the screen is supported, said support bars each including a pair of spaced vertical pins, and the frame unit including structure defining a circular hole and three slots, each aligned with one of the pins of the support bars so that the frame is supported for movement with the support bars, the circular hole defining a vertical axis about which the frame unit is pivoted upon actuation of the angular shifting means to adjust the angular alignment between the screen and the web;

a sensing means for sensing the correct positions and orientation of the indicia that are occupied when the defined areas of the web are in the predetermined relationship relative to the screen; and a control means responsive to the sensing means for controlling the longitudinal, lateral and angular shifting means to adjust the alignment between the screen and the web until the correct positions and orientation of the indicia are sensed.

25. In a screen printing press having a platen plate for supporting positioning indicium-bearing segments of material to be printed, a screen support adapted to hold a screen and proximal to the platen plate and movable between a printing position and an interrupted position, means for successively moving respective segments of said material along a path of travel and into a printing location between the platen plate and said screen support, and a registration device for assuring proper registration between each of said segments and said screen, said registration device including a sensor for sensing the location of the segment positioning indicia relative to a fixed reference, the improvement comprising:

a first adjusting assembly for selectively moving said platen plate transverse to said path of travel; and a second adjusting assembly for movement of said sensor transverse to said path of travel and relative to said platen plate so as to position the sensor relative to said segment indicia of segments of varying widths.

26. The press of claim 25, including lateral and angular shifting means for fine adjusting the lateral alignment between said screen and said material segments in a direction transverse to said path of travel, and for fine adjusting the angular alignment between said screen and said segments about a reference axis perpendicular to a plane containing the segments.

27. The press of claim 25, said platen plate including an elongated slot therein oriented transverse to said path of travel, said sensor located in alignment with said slot and selectively movable between a retracted position below said platen plate and a sensing position above the platen plate for sensing said positioning indicia.

28. The press of claim 27, said sensor being movable along the length of said slot.

29. The press of claim 25, said segments being a part of a continuous web, said moving means including structure for successively moving the web segments into said printing position.

* * * * *